US006177908B1

(12) United States Patent
Kawahata et al.

(10) Patent No.: US 6,177,908 B1
(45) Date of Patent: Jan. 23, 2001

(54) SURFACE-MOUNTING TYPE ANTENNA, ANTENNA DEVICE, AND COMMUNICATION DEVICE INCLUDING THE ANTENNA DEVICE

(75) Inventors: Kazunari Kawahata, Kyoto; Ken Okada, Yokohama; Atsuyuki Yuasa, Nagaokakyo; Shoji Nagumo, Mukou, all of (JP)

(73) Assignee: Murata Manufacturing Co., Ltd. (JP)

( * ) Notice: Under 35 U.S.C. 154(b), the term of this patent shall be extended for 0 days.

(21) Appl. No.: 09/300,678

(22) Filed: Apr. 27, 1999

(30) Foreign Application Priority Data

Apr. 28, 1998 (JP) ..... 10-118926

(51) Int. Cl.[7] ..... H01Q 1/38; H01Q 1/24

(52) U.S. Cl. ..... 343/700 MS; 343/702; 343/873

(58) Field of Search ..... 343/700 MS, 702, 343/846, 829, 848, 873; H01Q 1/38, 1/24

(56) References Cited

U.S. PATENT DOCUMENTS 5,748,149 * 5/1998 Kawahata ..... 343/700 MS
5,861,854 * 1/1999 Kawahate et al. ..... 343/700 MS
5,903,240 * 5/1999 Kawahata et al. ..... 343/700 MS

* cited by examiner

*Primary Examiner*—Hoanganh Le
(74) *Attorney, Agent, or Firm*—Ostrolenk, Faber, Gerb & Soffen, LLP

(57) ABSTRACT

The present invention provides a surface-mounting type antenna comprising: a base member made of an insulating material, including a first major surface, a second major surface opposite to the first major surface, and a plurality of side surfaces extending between the first and second major surfaces; a grounding electrode covering substantially the entire area of the first major surface of the base member; a strip-like radiation electrode mostly disposed on the second major surface, the radiation electrode having a first end and a second end, the first end being served as an open-ended terminal; a connecting terminal connected to the second end of the radiation electrode; a power-supply electrode disposed in the vicinity of the open-ended terminal of the radiation electrode; and a power-supply terminal connected to the power-supply electrode.

21 Claims, 8 Drawing Sheets

SURFACE-MOUNTING TYPE ANTENNA, ANTENNA DEVICE, AND COMMUNICATION DEVICE INCLUDING THE ANTENNA DEVICE

BACKGROUND OF THE INVENTION

1. Field of the Invention

The present invention relates to a surface-mounting type antenna, an antenna device, and a communication device including the antenna device. More particularly, the present invention relates to a surface-mounting type antenna, an antenna device, and a communication device including the antenna device which are to be used for mobile communication, etc.

2. Description of the Related Art

While the reduction in size and weight of mobile communication devices, particularly portable telephones in recent years is in progress, as for the antennas mounted on them the further reduction in size and weight, and increase in gain have been required.

In FIGS. 9 and 10, a conventional surface-mounting type antenna and an antenna device including the antenna device are shown respectively. The structure of the surface-mounting type antenna 30 in FIG. 9 is shown in Japanese Unexamined Patent Publication No. 10-13139.

In FIG. 9, the surface-mounting type antenna 10 is composed of some electrodes disposed on the surface of a base member 11 in the form of a rectangular solid made of a dielectric substance such as ceramics, resin, etc. as one insulating material. First, on the nearly whole surface of a first major surface 11*a* of the base member 11 the grounding electrode 12 is disposed. Further, on a second major surface 11*b* of the base member 11 a strip-like radiation electrode 13 is disposed along the long side of the base member 11. At a first end of the radiation electrode 13 an open-ended terminal 13*a* is provided, and ta second end is connected to a grounding electrode through a connecting electrode 14 disposed on an side surface 11*c* of the base member 11. Further, on the second major surface 11*b* of the base member 11 a power-supply electrode 15 located close to the open-ended terminal 13*a* of the radiation electrode 13 is disposed, and the power-supply electrode 15 is connected to a power-supply terminal 16 disposed over an side surface 11*d* to the first major surface 11*a* of the base member 11.

Here, when the surface-mounting type antenna 10 is mounted on a circuit board (not illustrated) because a power-supply terminal 16 is connected to a power-supply line on the side of the circuit board by soldering, etc., it is called the terminal in order to distinguish that from other electrodes. Hereinafter, when an electrode is described as a terminal, the electrode for connection to a circuit board is meant. However, there are cases in which electrodes and terminals are integrated, and then a part of the electrodes may be used as a terminal.

Next, in the antenna device 1 shown in FIG. 10, the surface-mounting type antenna 10 is mounted on the circuit-board grounding electrode 3 in the vicinity of a corner portion of the circuit board 2. The grounding electrode 12 and power-supply terminal 16 of the surface-mounting type antenna 10 are connected to the circuit-board grounding electrode 3 and power-supply line 4 disposed on the circuit board 2 by soldering, etc. respectively.

Here, in FIG. 11, an equivalent circuit of the antenna device 1 in FIG. 10 is shown. In FIG. 11, a capacitor CO represents capacitance produced between the power-supply electrode 15 and the grounding electrode 12 and circuit-board grounding electrode 3, a capacitor C1 capacitance between the power-supply electrode 15 and the open-ended terminal 13*a* of the radiation electrode 13, a capacitor C2 capacitance between the radiation electrode 13 and the grounding electrode 12 and circuit-board grounding electrode 3, conductance G a radiation resistor of the surface-mounting type antenna 10, and an inductance L1 and resistor R1 an inductance component and resistance component of the radiation electrode 13 respectively. Further, mark S represents a signal source. The inductance L and resistor R1 are connected in series, and one end of such is connected to the signal source S through the capacitor C1 and the other end is grounded. The connecting portion between the inductance L1 and capacitor C1 is grounded through the capacitor C2 and through the conductance G respectively. More, the connecting portion between the capacitor C1 and signal source S is grounded through the capacitor C0. And the resonance frequency of the antenna device 1 is determined mainly by the inductance L1 and capacitor C2.

Further, in FIGS. 12 and 13, another conventional surface-mounting type antenna and antenna device including the antenna device are shown. In FIG. 13, to the same or equivalent portions as in FIG. 10, the same reference numerals are given and their explanation is omitted. The structure of the surface-mounting type antenna 20 in FIG. 12 is shown in Japanese Unexamined Patent Publication No. 10-13139.

In FIG. 12, the surface-mounting type antenna 30 is composed of some electrodes disposed on the surface of a base member 31 in the form of a rectangular solid made up of a dielectric substance such as ceramics, resin, etc. as one insulating material. First of all, a strip-like radiation electrode 32 is disposed along the long side of the side surface 31*c* and over the second major surface 31*b* of the base member 31. A first end of the radiation electrode 32 is served as an open-ended terminal on the second major surface 31*b* of the base member 31, and a second end is connected to the grounding terminal 33 disposed on the first major surface 31*a* of the base member 31. Further, a power-supply electrode 34 is disposed on the second major surface 31*b* of the base member 31, and the power-supply electrode 34 is connected to a power-supply terminal 35 disposed over the side surface 31*d* to the first major surface 31*a* of the base member 31. In the same way, on the second major surface 31*b* of the base member 31, a grounding electrode 36 is disposed in the vicinity of the open-ended terminal 32*a* of the radiation electrode 32, and the grounding electrode 36 is connected to a grounding terminal 37 disposed over the side surface 31*d* to the first major surface 31*a* of the base member 31.

Next, in an antenna device 20 shown in FIG. 13, the surface-mounting type antenna 30 is mounted in an area 2*a* having no electrode disposed in the vicinity of a corner portion of the circuit board 2. The grounding terminals 33 and 37 and power-supply terminal 35 of the surface-mounting type antenna 30 are connected to the circuit-board grounding electrode 3 and power-supply line 4 respectively by soldering, etc.

Further, in an equivalent circuit of the antenna device 20, the capacitor C2 mainly represents a capacitance produced between the open-ended terminal 32*a* and the grounding electrode 36, grounding terminal 37, and circuit-board grounding electrodes of the radiation electrode 32, and the equivalent circuit is basically the same as in FIG. 11. Accordingly, here the explanation is omitted.

In order to realize the reduction in size of a communication device equipped with a surface-mounting type antenna, it is necessary to reduce the space occupied by the antenna device on the circuit board, and as a method for the reduction, the reduction in size of the surface-mounting type antenna itself is one choice to be considered.

In the surface-mounting type antennas shown in FIGS. 9 and 12, if the base member is simply made small, the length of the radiation electrode is reduced and as a result the inductance L1 of the radiation electrode is also reduced. Because of this, in order to realize the same inductance L1 on the equivalent circuit as before, it is necessary to make the radiation electrode thin or have the radiation electrode formed in a meandering way. However, in that case, there is a problem that the resistance component R1 of the radiation electrode is increased and the antenna gain is reduced. To the contrary, it may be considered that the increase of capacitance C2 compensates for the reduction of inductance L1 in order to keep the same resonance frequency, but for that purpose it is necessary to increase the dielectric constant of the base member and make the space between the open-ended terminal of the radiation electrode and the grounding electrode narrow and then there is a problem that because the radiation resistance G is increased, the antenna gain is reduced and the bandwidth is narrowed. As a result, in the communication device equipped with such an antenna device there occurs a problem that the antenna gain is lowered and the bandwidth is made narrow.

SUMMARY OF THE INVENTION

Then, the present invention is to present a surface-mounting type antenna, an antenna device, and a communication device which make it possible to reduce the occupied space by the surface-mounting type antenna on the circuit board.

To overcome the above described problems, the present invention provides a surface-mounting type antenna comprising: a base member made of an insulating material, including a first major surface, a second major surface opposite to the first major surface, and a plurality of side surfaces extending between the first and second major surfaces; a grounding electrode covering substantially the entire area of the first major surface of the base member; a strip-like radiation electrode mostly disposed on the second major surface, the radiation electrode having a first end and a second end, the first end being served as an open-ended terminal; a connecting terminal connected to the second end of the radiation electrode; a power-supply electrode disposed in the vicinity of the open-ended terminal of the radiation electrode; and a power-supply terminal connected to the power-supply electrode.

The present invention further provides an antenna device comprising: a circuit board on which a circuit-board grounding electrode is disposed; the above described surface-mounting type antenna mounted on the circuit board; and the connecting terminal of the surface-mounting type antenna being connected to the circuit-board grounding electrode through an inductance circuit provided on the circuit board.

The present invention further provides an antenna device comprising; a circuit board on which a circuit-board grounding electrode is disposed; a surface-mounting type antenna comprising: a base member made of an insulating material, including a first major surface, a second major surface opposite to the first major surface, and a plurality of side surfaces extending between the first and second major surfaces; strip-like radiation electrode disposed on the surface of the base member, the radiation electrode having a first end and a second end, the first end being served as an open-ended terminal; a connecting terminal connected to the second end of the radiation electrode; a power-supply electrode disposed on the surface of the base member; and a power-supply terminal connected to the power-supply electrode; the surface-mounting type antenna being mounted on the circuit board, the connecting terminal of the surface-mounting type antenna being connected to the circuit-board grounding electrode through an inductance circuit provided on the circuit board.

In the above described antenna device, the surface-mounting type antenna may be mounted in the vicinity of the corner portion of the circuit board in such a way that; a portion of the base member at which the connecting terminal is disposed directs the corner portion of the circuit board, a portion of the base member at which the open-ended terminal of the radiation electrode is disposed separates from the corner portion on the side edge of the circuit board, and the inductance circuit is disposed in the vicinity of the corner of the circuit board.

In the above described antenna device, the inductance circuit may comprise a linear pattern disposed on the circuit board.

In the above described antenna device, the inductance circuit may comprise a chip-inductor.

In the above described antenna device, the inductance circuit may comprises a variable inductance circuit including diodes.

The present invention further provides a communication device comprising the above described antenna device.

According to a surface-mounting type antenna and an antenna device of the present invention, the space occupied by the surface-mounting type antenna on the circuit board is able to be reduced, and at the same time the bandwidth and gain are able to be improved.

Further, in a communication device of the present invention, lower costs are able to be attained.

Other features and advantages of the present invention will become apparent from the following description of the invention which refers to the accompanying drawings.

DESCRIPTION OF THE PREFERRED EMBODIMENTS

Figure 1:
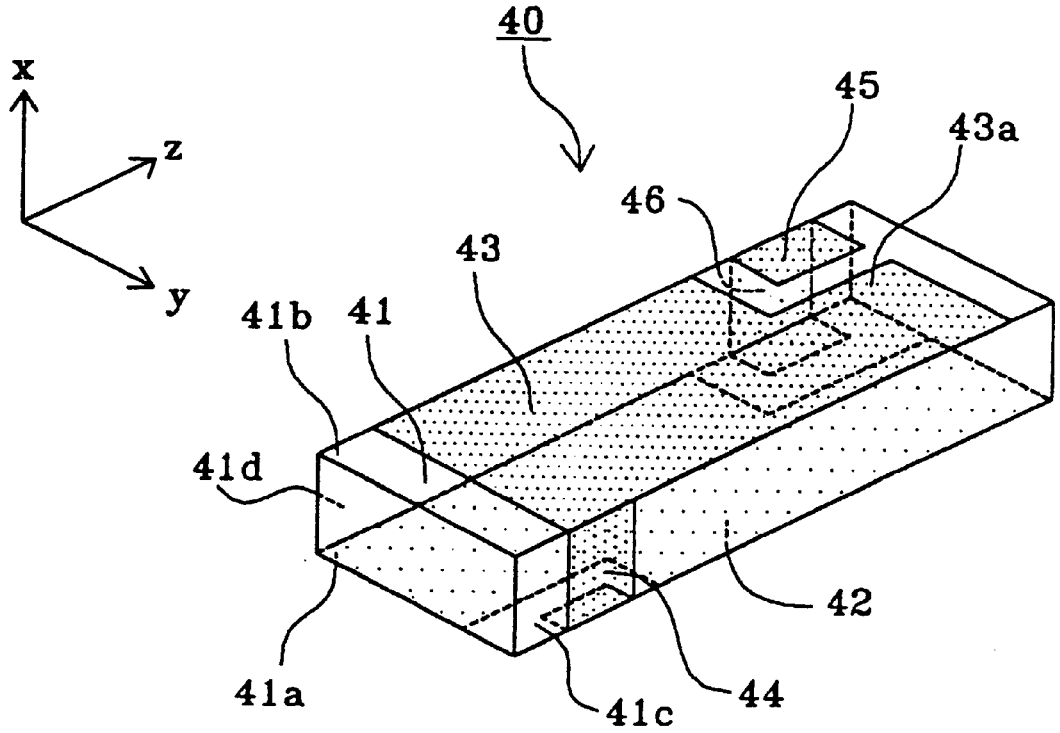
FIG. 1 is a perspective view showing a preferred embodiment of a surface-mounting type antenna of the present invention.

In FIG. 1, one embodiment of a surface-mounting type antenna of the present invention is shown. In FIG. 1, the surface-mounting type antenna 40 is composed of some electrodes disposed on the surface of a base member 41 in the form of a rectangular solid made up of a dielectric substance such as ceramics, resin, etc. as one insulating material. First of all, on the substantially whole surface of a first major surface 41*a* of the base member 41 a grounding electrode 42 is disposed. Further, on a second major surface 41 b of the base member 41 a strip-like radiation electrode 43 is disposed along the long side of the base member 41. At a first end of the radiation electrode 43 an open-ended terminal 43*a* is disposed, and a second end is connected to a connecting terminal 44 disposed over an side surface 41*c* of the base member 41 to the first major surface 41*a*. More, the connecting terminal 44 and the grounding electrode 42 are insulated from each other. Further, on the second major surface 41 b of the base member 41 a power-supply electrode 45 located in the vicinity of the open-ended terminal 43*a* of the radiation electrode 43 is disposed, and the power-supply electrode 45 is connected to a power-supply terminal 46 disposed over the side surface 41*d* to the first major surface 41*a* of the base member 41.

Figure 2:
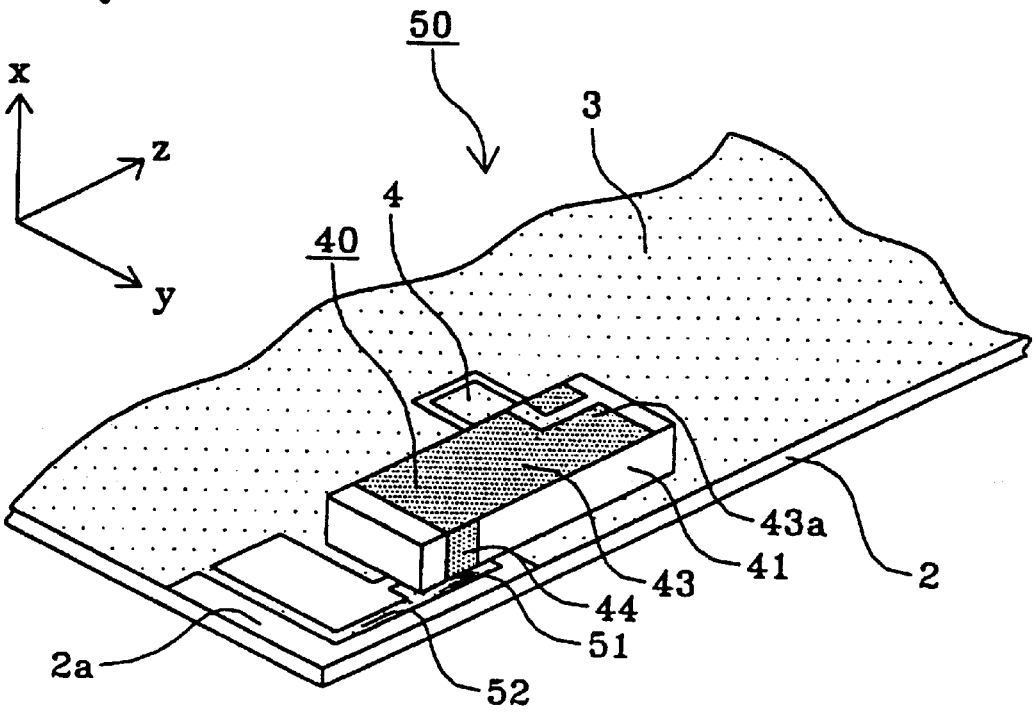
FIG. 2 is a perspective view showing a preferred embodiment of an antenna device of the present invention.
Figure 10:
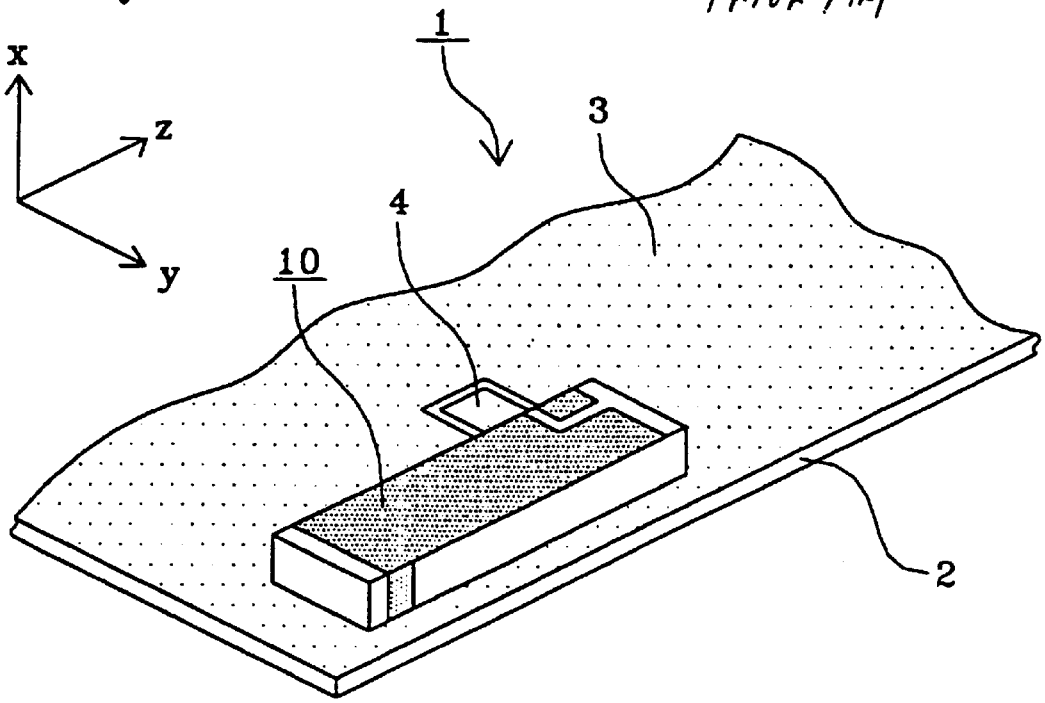
Fig. 10 Prior Art
FIG. 10 is a perspective view showing a surface-mounting type antenna included in the antenna device in FIG. 9.

Next, in FIG. 2, an antenna device of the present invention is shown. In FIG. 2, to the same or equivalent portions as in FIGS. 1 and 10 the same reference numerals are given and their explanation is omitted.

In the antenna device 50 shown in FIG. 2, the surface-mounting type antenna 40 is mostly mounted on the circuit-board grounding electrode 3 in the vicinity of a corner portion of the circuit board 2. The surface-mounting type antenna 40 is arranged so as to direct the portion having the connecting terminal 44 formed, of the base member 41 toward the comer portion of the circuit board 2 and to direct the portion having an open-ended terminal 43*a*, of the radiation electrode 43 in the direction of being separated from the corner portion on the side edge of the circuit board 2. The grounding electrode 42 and power-supply terminal 46 of the surface-mounting type antenna 40 are connected to the circuit-board grounding electrode 3 and power-supply line 4 disposed on the circuit board 2 respectively. And the connecting terminal 44 of the surface-mounting type antenna 40 is connected by soldering, etc. to an external connecting electrode 51 formed in an area 2*a* having no circuit-board grounding electrode disposed on the circuit board 2, and the external connecting electrode 51 is connected to the circuit-board grounding electrode 3 through a linear pattern 52 as an inductance circuit.

Figure 3:
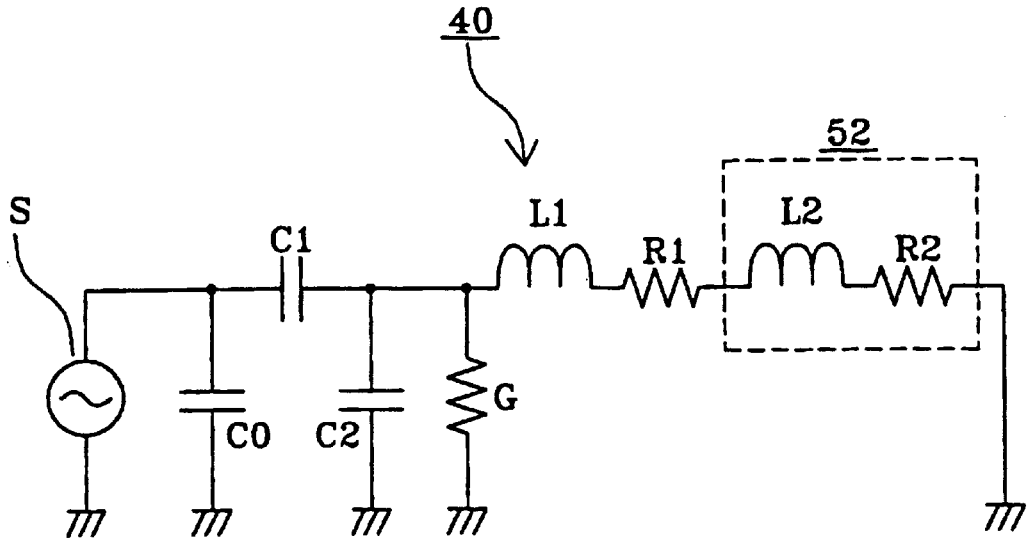
FIG. 3 shows an equivalent circuit of the antenna device in FIG. 2.
Figure 11:
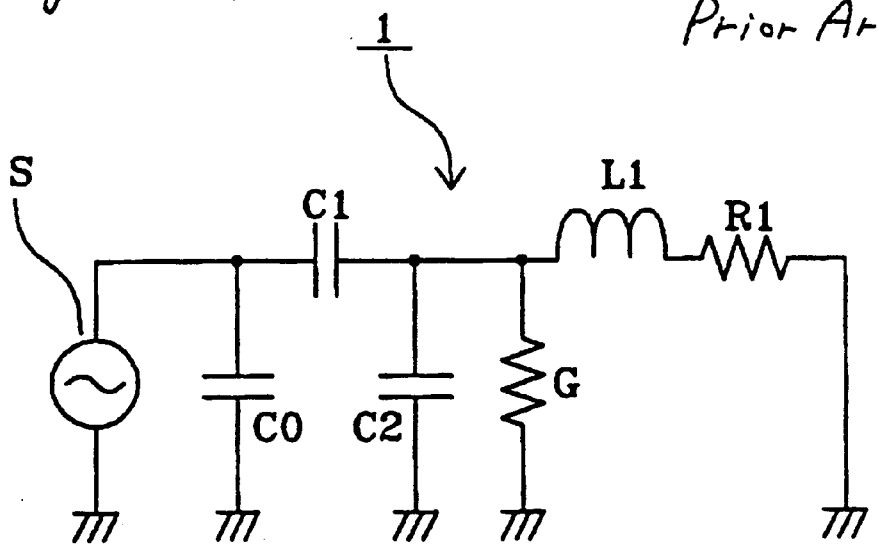
Fig. 11 Prior Art
FIG. 11 shows an equivalent circuit of the antenna device in FIG. 10.

Here, in FIG. 3, an equivalent circuit of the antenna device 50 in FIG. 2 is shown. In FIG. 3, to the same or equivalent portions as in FIG. 11 the same reference numerals are given and their explanation is omitted.

In FIG. 3, the inductance L2 and resistance R2 represent an inductance component and resistance component of the linear pattern 52 disposed on the circuit board 2. Further, one end of a resistor R1 is not directly grounded, and is grounded through the inductance L2 and resistance R2 in succession. And the resonance frequency of the antenna device 50 is determined mainly by the inductance L1 and L2, and capacitance C2.

In this way, in the antenna device 50 of the present invention, because the second end of the radiation electrode 43 of the surface-mounting type antenna 40 is grounded through the connecting terminal 44 and linear pattern 52, the real inductance component of the antenna as a whole is increased and the resonance frequency is reduced. In the converse way, this means that if the frequency as a target is the same, the inductance L1 of the radiation electrode 43 is able to be reduced as much as the increase of inductance L2 by the linear pattern 52. And the fact that the inductance L1 of the radiation electrode 43 is able to be reduced leads to the possibility of a shorter radiation electrode 43, that is, a smaller-sized surface-mounting type antenna 40 by making the base member 41 shorter.

In this way, in the antenna device 50 of the present invention, by shortening the length of the surface-mounting type antenna 40 to be mounted, a linear pattern 52 is able to be formed in the area occupied by the shortened portion on the circuit board 2. As the linear pattern 52 has little height in comparison with the surface-mounting type antenna 40, the occupied volume by an antenna device including the surface-mounting type antenna 40 and linear pattern 52 is able to be made smaller than in the case of the conventional surface-mounting type antenna 10 mounted on the circuit board 2.

Further, because the portion in which the linear pattern 52 is formed corresponds to a corner portion on the circuit board 2, no parts are mounted at the corner portion. Because of this, the thickness of the circuit board 2 including the mounted parts is made thin at the comer portion. Then, there is a merit of the increased freedom of designing in such a way that a cover of the circuit board 2 is able to be made matched to the circuit board 2 by rounding a part of the cover corresponding to the corner portion of the circuit board 2.

Further, according to an antenna device 50 of the present invention, the bandwidth as an antenna is able to be widened, and the gain is also able to be increased.

According to the experiment conducted by the inventors of the application concerned, in the case of the conventional antenna device, if the dimension of a surface-mounting type antenna is 15 mm×3 mm×1.8 mm, the occupied space becomes 81 cubic millimeters. On the other hand, in the case of the antenna device of the present invention, if the dimension of a surface-mounting type antenna is 12 mm×3 mm×1.8 mm, the occupied space was able to be made 64.8 cubic millimeters. As a result, according to an antenna device of the present invention, the occupied space of the antenna device as a whole was able to be reduced to about 80%.

Further, in the conventional antenna device, the bandwidth of the antenna was 24.0 MHz, and the maximum antenna gain was −2.7 dBd and the average gain −4.6 dBd. However, in the antenna device of the present invention, the bandwidth of the antenna was expanded to 24.1 MHz, and the maximum antenna gain became −2.1 dBd and the average gain −3.8 dBd, which means an extensive improvement.

Further, according to the antenna device 50 of the present invention, because the inductance L2 of the linear pattern 52 formed on the circuit board 2 is able to be designed independently of the surface-mounting type antenna 40, after the surface-mounting type antenna 40 has been designed so as to give the best capacitance C2 and conductance G, it is possible to independently determine the inductance L2 for deciding the resonance frequency by designing the length and shape of the linear pattern 52. Thus, it is possible to extend the freedom of designing antenna devices.

Further, the antenna device 50 of the present invention is disposed in the vicinity of a corner portion of the circuit board so as to direct the portion having a connecting terminal formed, of the base member toward a corner portion of the circuit board and to direct the portion having an open-ended terminal of the radiation electrode formed in the direction of being separated from a comer portion on the side edge, of the circuit board. By arranging the surface-mounting type antenna 40 on the circuit board 2 in this way, the gain is able to be further increased.

According to the experiment by the inventors of the application concerned, when the direction of the surface-mounting type antenna is reversed, the maximum antenna gain becomes −9.6 dBd and this is greatly deteriorated in comparison with the former gain of −2.1 dBd. Thus, by the surface-mounting type antenna arranged so as to direct the portion having a connecting terminal formed, of the base member toward a corner portion of the circuit board and to direct the portion having an open-ended terminal of the radiation electrode formed in the direction of being separated from a corner portion on the side edge, of the circuit board, the improvement of the antenna gain was able to be confirmed.

Figure 4:
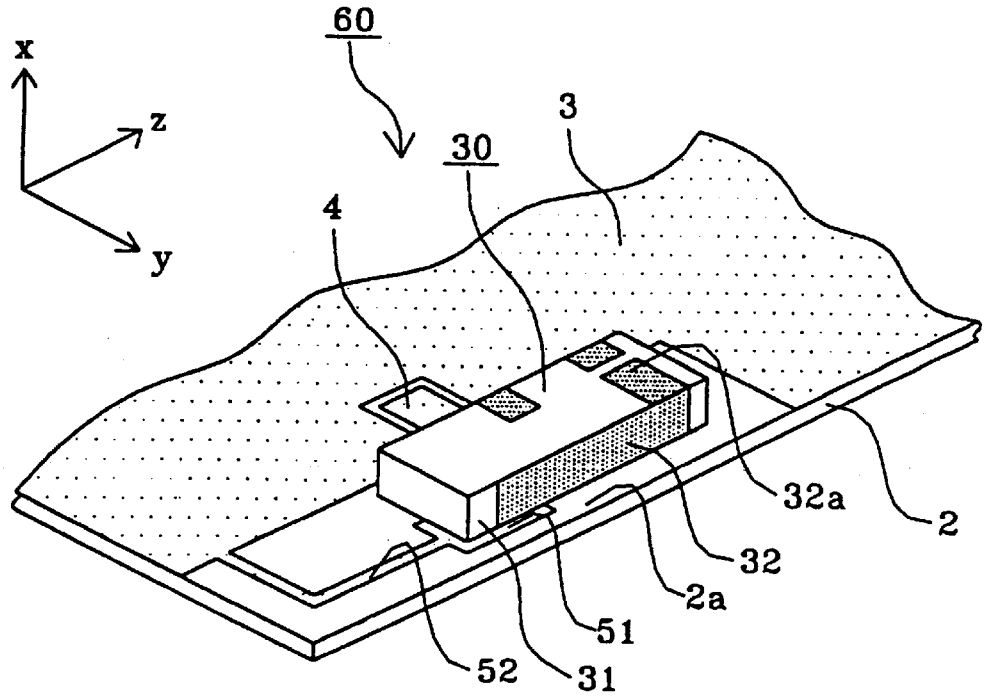
FIG. 4 is a perspective view showing another preferred embodiment of an antenna device of the present invention.
Figure 12:
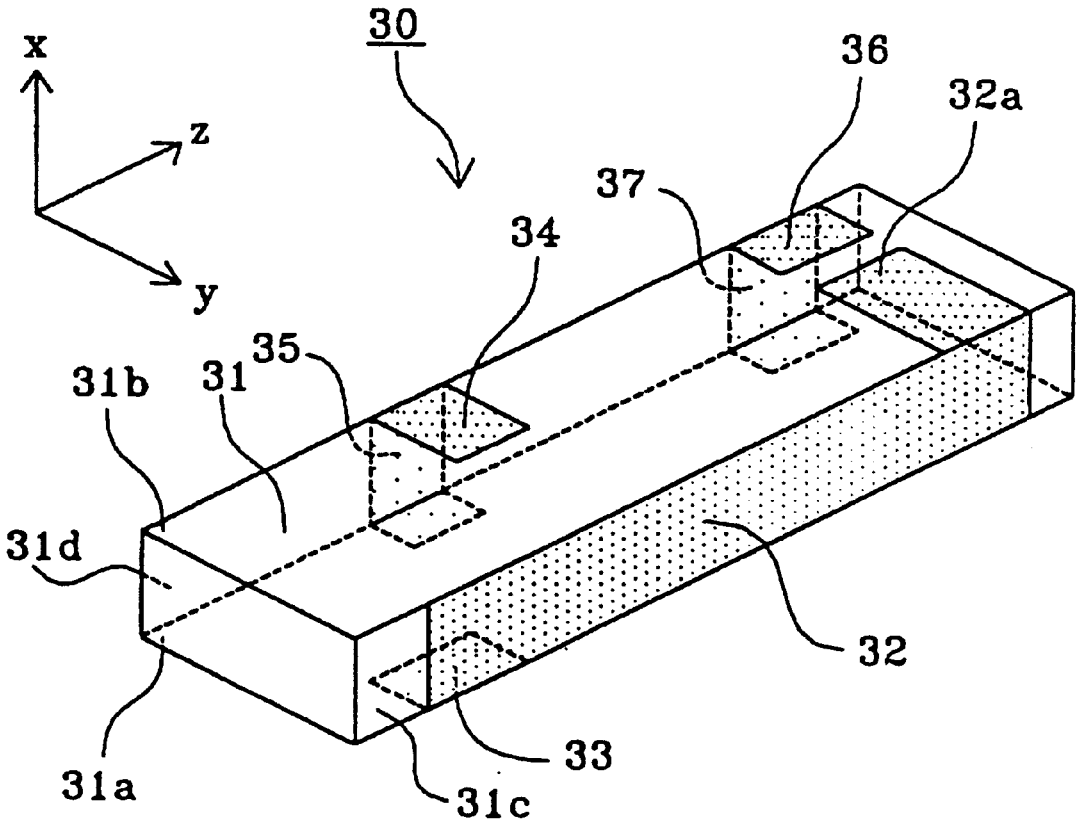
Fig. 12 Prior Art
FIG. 12 is a perspective view showing another conventional antenna device.
Figure 13:
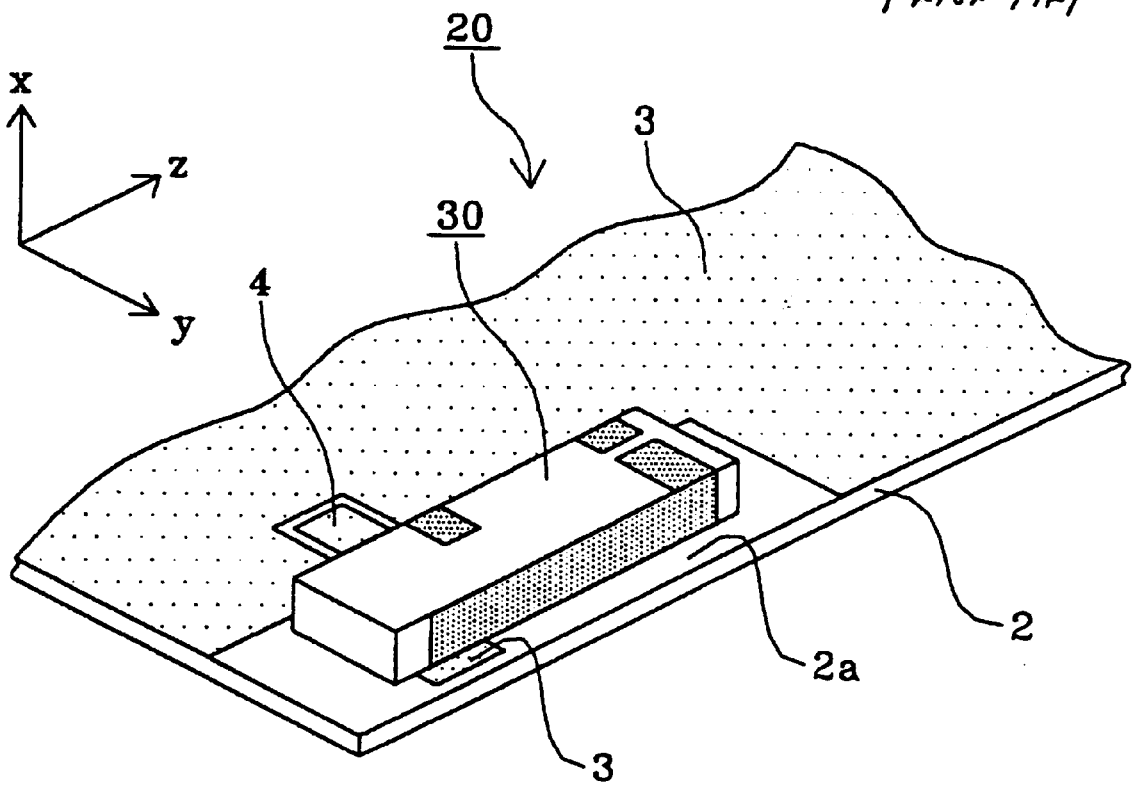
Fig. 13 Prior Art
FIG. 13 is a perspective view showing a surface-mounting type antenna included in the antenna device in FIG. 12.

In FIG. 4, another embodiment of an antenna device of the present invention is shown. In FIG. 4, to the same or equivalent portions as in FIGS. 2, 12, and 13 the same reference numerals are given and their explanation is omitted.

In the antenna device 60 shown in FIG. 4, the grounding terminal 33 of the surface-mounting type antenna 30 is not directly connected to the circuit-board grounding electrode 3 of the circuit board 2, but connected by soldering, etc. to an external connecting electrode 51 formed in the area 2*a* not having the circuit-board grounding electrode 3 formed on the circuit board 2, and the external connecting electrode 51 is connected to the circuit-board grounding electrode 3 through the linear pattern 52 as an inductance circuit. That is, the grounding terminal 33 of the surface-mounting type antenna 30 is used with the same purpose as the connecting terminal 44 of the surface-mounting type antenna 40 in the antenna device 50. Therefore, hereinafter, the grounding terminal 33 is called the connecting terminal 33.

More, the equivalent circuit of the antenna device 60 is basically the same as in FIG. 3, and the explanation is omitted here.

In the antenna device 60 constructed in this way, in proportion to the inductance L2 by the linear pattern 52 increased, the length of the base member 31 is able to be reduced to shorten the length of the radiation electrode 32 as in the antenna device 50. Accordingly, it is possible to make the surface-mounting type antenna 30 smaller-sized and to reduce the occupied space of the surface-mounting type antenna. Further, it is possible to increase the bandwidth of the antenna and the antenna gain.

Further, because the inductance L2 of the linear pattern 52 formed on the circuit board 2 is able to be designed independently of the surface-mounting type antenna 30, after the side of the surface-mounting type antenna 30 has been designed to have the most appropriate capacitance C2 and conductance G, the inductance L2 for deciding the resonance frequency is able to be independently designed by changing the length and shape of the linear pattern 52, and accordingly the freedom for mounting the surface-mounting type antenna is able to be increased. Furthermore, it is possible to increase the antenna gain more by the surface-mounting type antenna 30 arranged so as to direct the portion having the connecting terminal 33 formed, of the base member 31 toward a corner portion of the circuit board and to direct the portion having an open-ended terminal 32*a* formed, of the radiation electrode 32 in the direction of being separated from a corner portion on the side edge of the circuit board 2.

Figure 5:
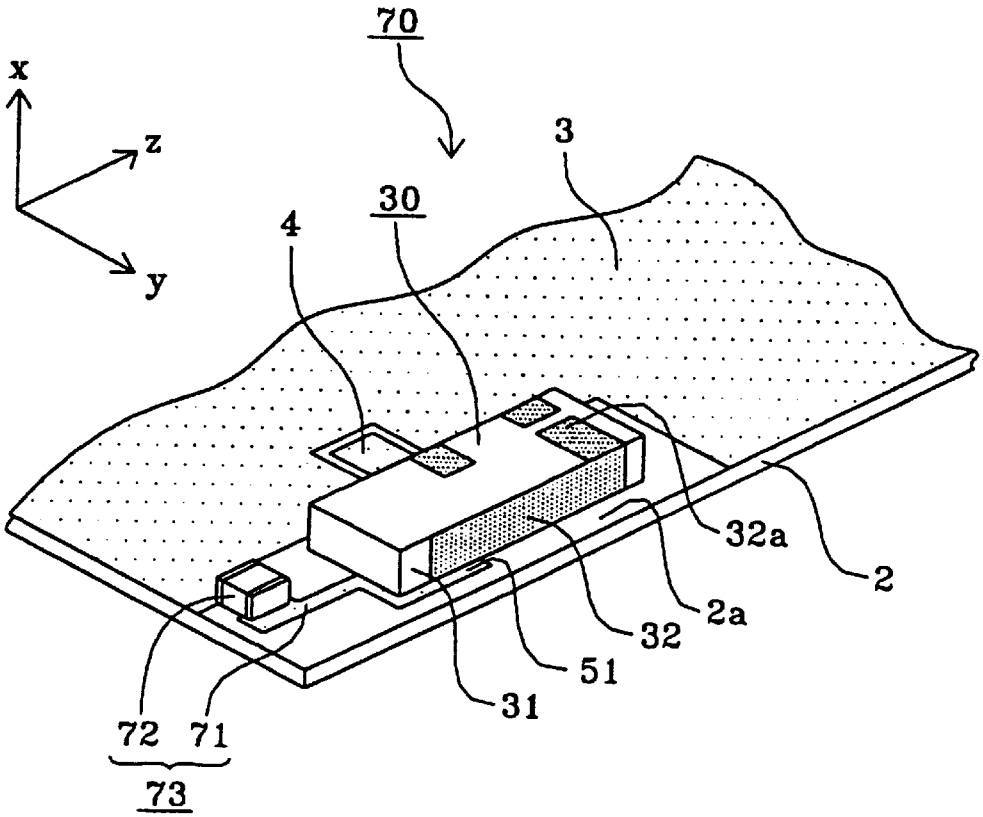
FIG. 5 is a perspective view showing further another preferred embodiment of an antenna device of the present invention.

In FIG. 5, further another preferred embodiment of an antenna device of the present invention is shown. In FIG. 5, to the same or equivalent portions as in FIG. 4 the same reference numerals are given and their explanation is omitted.

In the antenna device 70 shown in FIG. 5, the external connecting electrode 51 disposed in an area 2*a* having no circuit-board grounding electrode disposed on the circuit board 2 is connected to the circuit-board grounding electrode 3 through an inductance circuit 73 made up of a relatively short connecting wiring 71 having less inductance and a chip-inductor 72. That is, instead of the linear pattern 52 in the antenna device 60, the inductance circuit 73 composed of a connecting wiring 71 and a chip-inductor 72 is given.

Even if the inductance circuit is composed of a connecting wiring 71 and a chip-inductor 72 in this way, the antenna device 70 is quite the same as the antenna device 60 from the viewpoint of equivalent circuit and shows the same working-effect as the surface-mounting type antenna 60, except that the occupied space by the antenna is slightly increased in accordance with the height of the chip-inductor.

Figure 6:
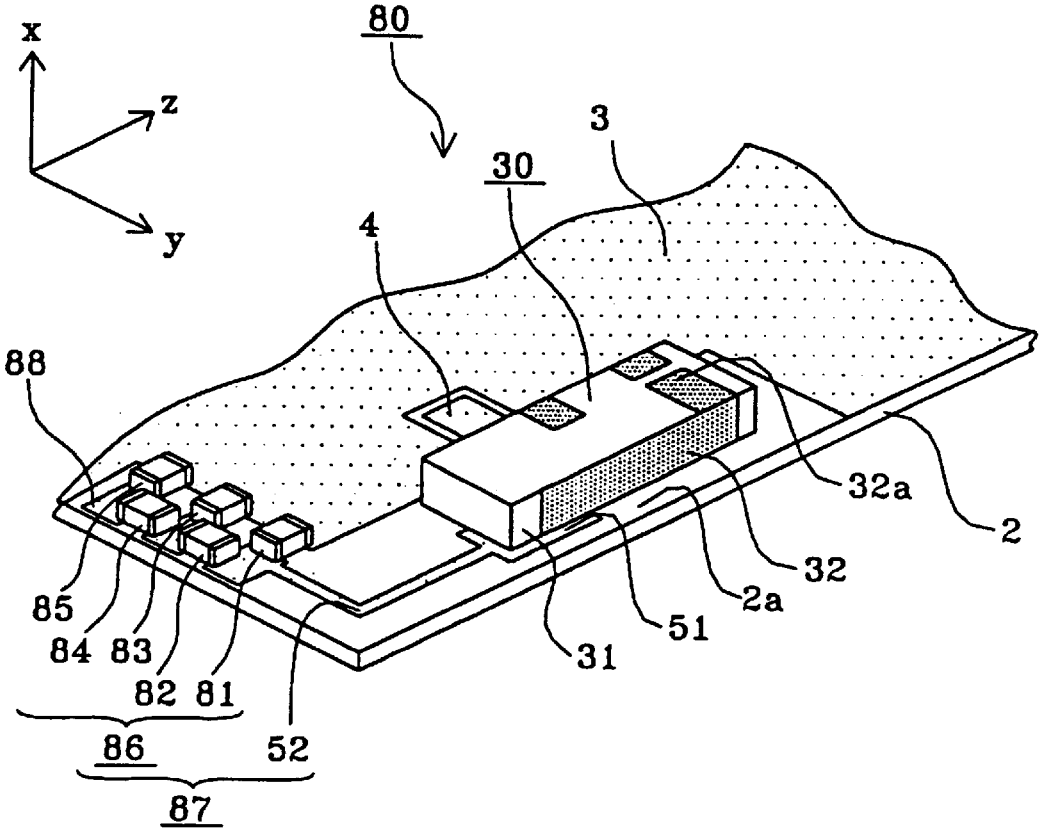
FIG. 6 is a perspective view showing further another preferred embodiment of an antenna device of the present invention.

In FIG. 6, further another preferred embodiment of an antenna device of the present invention is shown. In FIG. 6, to the same or equivalent portions as in FIG. 4 the same reference numerals are given and their explanation is omitted.

In the antenna device 80 shown in FIG. 6, one end of the linear pattern 52 is connected to an external connecting electrode 51, and the other end of the linear pattern 52 is connected to a switching electrode 88 through the variable inductance circuit 86 composed of a diode 81, a chip-inductor 82, a chip-capacitor 83, a chip-resistro84, and a chip-capacitor 85.

Here, in the variable inductance circuit 86, the other end of the linear pattern 52 is connected to the circuit-board grounding electrode 3 through a diode 81. Further, the other end of the linear pattern 52 is connected to the switching electrode 88 through a chip-inductor 82 and a chip-resistor 84. And both ends of the chip-resistor 84 are connected to the circuit-board grounding electrode 3 through a chip-capacitor 83 and a chip-capacitor 85 respectively.

Figure 7:
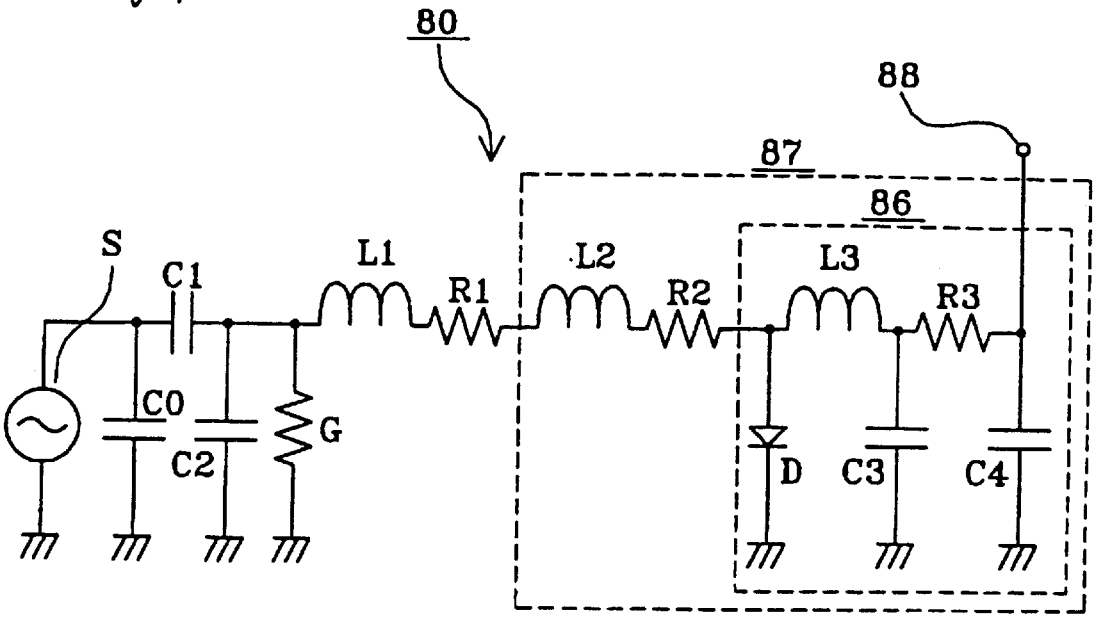
FIG. 7 shows an equivalent circuit of the antenna device in FIG. 6.

Here, in FIG. 7, an equivalent circuit of the antenna device 80 is shown. In FIG. 7, to the same or equivalent portions as in FIG. 3 the same reference numerals are given and their explanation is omitted.

In FIG. 7, a diode D represents the diode 81, inductance L3 the inductance component of the chip-inductor 82, capacitance C3 the capacitance component of the chip-capacitor 83, resistance R3 the resistance component of the chip-resistor 84, and capacitance C4 the capacitance component of the chip-capacitor 85 respectively. One end of resistance R2 is grounded through the diode D, and connected to the switching electrode 88 through the inductance L3 and resistance R3. And both ends of resistance R3 are grounded through capacitance C3 and capacitance C4 respectively.

Here, the resistance R3 limits the direct current flowing through the diode D. Further, the capacitance C3 functions so as to lower the impedance at the resonance frequency of the antenna device 80 and to ground the connecting portion between the inductance L3 and resistance R3 at high frequencies. Further, the capacitance C4 functions as a bypass capacitor. And the resonance frequency of the antenna device 80 is determined mainly by the inductance L1, L2, and L3, and capacitance C2.

In the antenna device 80 thus constructed, when no voltage or any negative voltage is applied to the switching electrode 88, the diode D is turned into nonconductive state. Because of this, the resonance frequency of the antenna device 80 is determined mainly by the inductance L1, L2, and L3, and the capacitance C2. On the other hand, when a positive voltage over a certain level is applied to the switching electrode 88, the diode D is biased in the forward direction and turned into a conductive state, that is, the state of the connecting portion between the resistance R2 and inductance L3 being grounded. Because of this, the resonance frequency of the antenna device 80 comes to be determined mainly by the inductance L1 and L2 and the capacitance C2, and becomes higher than at the time when the diode D is in nonconductive state. Because of this fact, it is understood that the resonance frequency of the antenna device 80 is able to be changed by the voltage applied to the switching electrode 88.

Therefore, in the antenna device 80 of the present invention, in addition to the working-effect of each of the above-described antenna devices the resonance frequency is able to be easily changed.

More, the variable inductance circuit is not limited to this construction. When the value of inductance is able to be changed by allowing a diode to function as a high-frequency switch, any construction is acceptable.

Further, in each of the above-described preferred embodiments, the radiation electrode of the surface-mounting type antenna was formed in a linear shape or in the shape of letter L, but others in the shape of letter U, in a meandering shape, etc. are acceptable. Further, it was stated that the base member of the surface-mounting type antenna is made up of a dielectric substance such as ceramics, resin, etc., but a magnetic substance is also able to be used.

Figure 8:
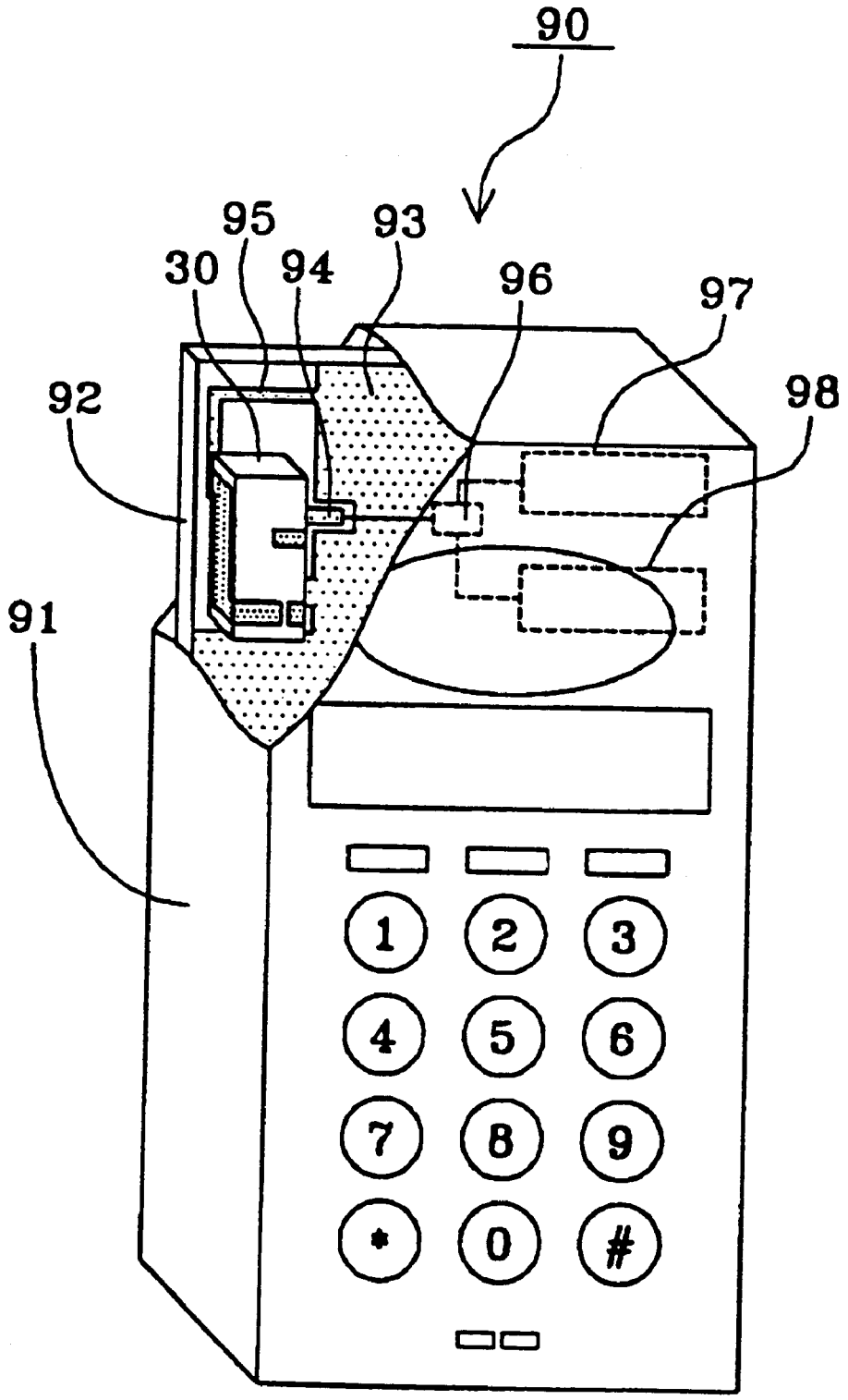
FIG. 8 is a perspective view showing a preferred embodiment of a communication device of the present invention.
Figure 9:
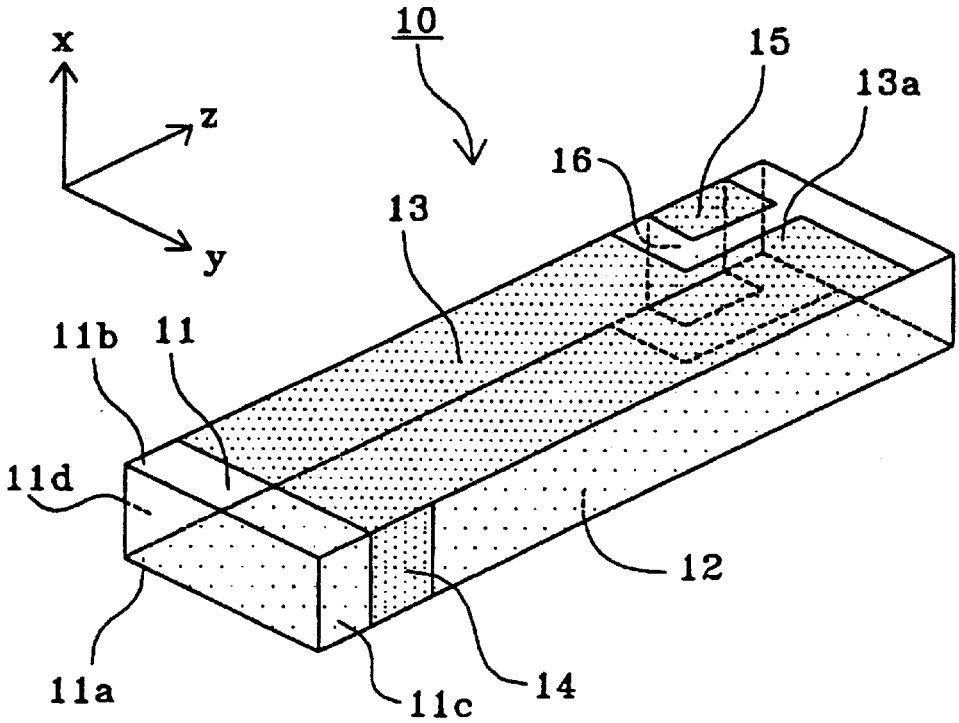
Fig. 9 Prior Art
FIG. 9 is a perspective view showing a conventional antenna device.

In FIG. 8, one preferred embodiment of a communication device including an antenna device of the present invention is shown. In FIG. 8, the communication device 90 is composed of a circuit board 92 given in an enclosure 91, and a circuit-board grounding electrode 93, a power-supply line 94, and a linear pattern 95 are disposed on the circuit board 92. In a corner portion of the circuit board 92, there is an area in which the circuit-board grounding electrode 93 is not formed and in this area a surface-mounting type antenna 30 is mounted. The antenna device is composed of the surface-mounting type antenna 30 the grounding terminal (not illustrated) of which is connected to the circuit-board grounding electrode 93 through the linear pattern 95 on the circuit board 92 and of the power-supply terminal (not illustrated) which is connected to the power-supply line 94 on the circuit board 92. Furthermore, the power-supply line 94 is connected to a transmission circuit 97 and reception circuit 98 formed on the circuit board 92 through a switching circuit 96 formed on the same circuit board 92.

In this way, by using an antenna device of the present invention, the freedom of mounting each of the parts in the communication device 90 is increased, and the bandwidth and antenna gain of the communication device 90 is able to be increased.

More, in the preferred embodiment of FIG. 8, the communication device 90 is composed of an antenna device 60, but the use of antenna devices 50, 70, 80 also gives the same working-effect.

According to a surface-mounting type antenna and an antenna device of the present invention, by grounding the other end of the radiation electrode composed of a surface-mounting type antenna having one end as an open-ended terminal through an inductance circuit made up of a linear pattern, a chip-inductor, etc. provided on a circuit board, the surface-mounting type antenna is made small-sized and the occupied space by the antenna is able to be reduced. Further, it is possible to widen the bandwidth and improve the antenna gain. Further, because the radiation resistance is able to be designed on the side of the surface-mounting type antenna and the resonance frequency on the side of the circuit board independently, the freedom of designing the antenna device is able to be increased. Further, by arrangement in the vicinity of the corner portion of the circuit board so as to direct the portion having a connecting terminal formed, of the base member toward a corner portion of the circuit board and to direct the portion having an open-ended terminal, of the radiation electrode in the direction of being separated from the comer portion on the side edge of the circuit board, the antenna gain is able to be further increased. Further, by construction of an inductance circuit using a variable inductance circuit having diodes, the resonance frequency of the antenna is able to be changed.

Further, according to a communication device of the present invention, by using the above-mentioned antenna device, the freedom of mounting each of the parts inside the communication device is increased, and the bandwidth and antenna gain are able to be increased.

While the invention has been particularly shown and described with reference to preferred embodiments thereof, it will be understood by those skilled in the art that the forgoing and other changes in form and details may be made therein without departing from the spirit of the invention.

What is claimed is:

1. An antenna device comprising:

a circuit board on which a circuit-board grounding electrode is disposed;

a surface-mounting type antenna mounted on the circuit board, the surface mounting type antenna comprising a base member made of an insulating material, including a first major surface, a second major surface opposite to the first major surface, and a plurality of side surfaces extending between the first and second major surfaces;

a grounding electrode covering substantially the entire area of the first major surface of the base member;

a strip-like radiation electrode disposed on the second major surface, the radiation electrode having a first end and a second end, the first end comprising an open-ended terminal;

a connecting terminal connected to the second end of the radiation electrode;

a power-supply electrode disposed in the vicinity of the open-ended terminal of the radiation electrode; and a power-supply terminal connected to the power-supply electrode, and the connecting terminal of the surface-mounting type antenna being connected to the circuit-board grounding electrode through an inductance circuit provided on the circuit board.

2. The antenna device according to claim 1, wherein the surface-mounting type antenna is mounted in the vicinity of the comer portion of the circuit board in such a way that; a portion of the base member at which the connecting terminal is disposed directs the corner portion of the circuit board, a portion of the base member at which the open-ended terminal of the radiation electrode is disposed separates from the corner portion on the side edge of the circuit board, and the inductance circuit is disposed in the vicinity of the corner of the circuit board.

3. The antenna device according to claim 2, wherein the inductance circuit comprises a linear pattern disposed on the circuit board.

4. The antenna device according to claim 2, wherein the inductance circuit comprises a chip-inductor.

5. The antenna device according to claim 2, wherein the inductance circuit comprises a variable inductance circuit including diodes.

6. The antenna device according to claim 1, wherein the inductance circuit comprises a linear pattern disposed on the circuit board.

7. The antenna device according to claim 6, wherein the inductance circuit comprises a variable inductance circuit including diodes.

8. The antenna device according to claim 1, wherein the inductance circuit comprises a chip-inductor.

9. The antenna device according to claim 8, wherein the inductance circuit comprises a variable inductance circuit including diodes.

10. The antenna device according to claim 1, wherein the inductance circuit comprises a variable inductance circuit including diodes.

11. An antenna device comprising:

a circuit board on which a circuit-board grounding electrode is disposed;

a surface-mounting type antenna comprising: a base member made of an insulating material, including a first major surface, a second major surface opposite to the first major surface, and a plurality of side surfaces extending between the first and second major surfaces; a strip-like radiation electrode disposed on one of the first and second major surfaces of the base member, the radiation electrode having a first end and a second end, the first end comprising an open-ended terminal; a connecting terminal connected to the second end of the radiation electrode; a power-supply electrode disposed on the other of the first and second major surfaces of the base member; and a power-supply terminal connected to the power-supply electrode;

the surface-mounting type antenna being mounted on the circuit board, the connecting terminal of the surface-mounting type antenna being connected to the circuit-board grounding electrode through an inductance circuit provided on the circuit board.

12. The antenna device accord to claim 11, wherein the surface-mounting type antenna is mounted in the vicinity of the corner portion of the circuit board in such a way that; a portion of the base member at which the connecting terminal is disposed directs the corner portion of the circuit board, a portion of the base member at which the open-ended terminal of the radiation electrode is disposed separates from the corner portion on the side edge of the circuit board, and the inductance circuit is disposed in the vicinity of the corner of the circuit board.

13. The antenna device according to claim 11, wherein the inductance circuit comprises a linear pattern disposed on the circuit board.

14. The antenna device according to claim 11, wherein the inductance circuit comprises a chip-inductor.

15. The antenna device according to claim 11, wherein the inductance circuit comprises a variable inductance circuit including diodes.

16. A communication device comprising an antenna device, comprising a circuit board on which a circuit-board grounding electrode is disposed;

a surface-mounting type antenna mounted on the circuit board, the surface mounting type antenna comprising:

a base member made of an insulating material including a first major surface a second major surface opposite to the first major surface, and a plurality of side surfaces extending between the first and second major surfaces, a grounding electrode covering substantially the entire area of the first major surface of the base member;

a strip-like radiation electrode disposed on the second major surface, the radiation electrode having a first end and a second end, the first end comprising an open-ended terminal;

a connecting terminal connected to the second end of the radiation electrode;

a power-supply electrode disposed in the vicinity of the open-ended terminal of the radiation electrode; and a power-supply terminal connected to the power-supply electrode, and the connecting terminal of the surface-mounting type antenna being connected to the circuit-board grounding electrode through an inductance circuit provided on the circuit board.

17. The communication device according to claim 16, further wherein the surface-mounting type antenna is mounted in the vicinity of the corner portion of the circuit board in such a way that; a portion of the base member at which the connecting terminal is disposed directs the corner portion of the circuit board, a portion of the base member at which the open-ended terminal of the radiation electrode is disposed separates from the comer portion on the side edge of the circuit board, and the inductance circuit is disposed in the vicinity of the comer of the circuit board.

18. The communication device according to claim 16, further wherein the inductance circuit comprises a linear pattern disposed on the circuit board.

19. The communication device according to claim 16, further wherein the inductance circuit comprises a chip-inductor.

20. The communication device according to claim 16 further wherein the inductance circuit comprises a variable inductance circuit including diodes.

21. A communication device comprising an antenna device comprising a circuit board on which a circuit-board grounding electrode is disposed;

a surface-mounting type antenna comprising: a base member made of an insulating material, including a first major surface, a second major surface opposite to the first major surface, and a plurality of side surfaces extending between the first and second major surfaces; a strip-like radiation electrode disposed on one of the first and second major surfaces of the base member, the radiation electrode having a first end and a second end, the first end comprising an open-ended terminal; a connecting terminal connected to the second end of the radiation electrode: a power-supply electrode disposed on the other of the first and second major surfaces of the base member; and a power-supply terminal connected to the power-supply electrode;

the surface-mounting type antenna being mounted on the circuit board, the connecting terminal of the surface-mounting type antenna being connected to the circuit-board grounding electrode through an inductance circuit provided on the circuit board.

* * * * *